United States Patent [19]

Nomura et al.

[11] Patent Number: 4,898,110

[45] Date of Patent: Feb. 6, 1990

[54] PATTERN-MATCHING SEWING MACHINE

[75] Inventors: Etsuzo Nomura, Kasugai; Hirokazu Takeuchi; Shigeru Suzuki, both of Nagoya; Kazunori Irie, Ichinomiya; Hirosumi Itoh, Nagoya, all of Japan

[73] Assignee: Kogyo Kabushiki Kaisha, Aichi, Japan

[21] Appl. No.: 302,679

[22] Filed: Jan. 27, 1989

[30] Foreign Application Priority Data

Jan. 28, 1988 [JP] Japan ..... 63-17696

[51] Int. Cl.[4] ..... D05B 27/06; D05B 27/08

[52] U.S. Cl. ..... 112/314; 112/121.11; 112/320

[58] Field of Search ..... 112/314, 313, 312, 315, 112/316, 262.1, 121.11, 121.26, 272, 121.25, 320

[56] References Cited

U.S. PATENT DOCUMENTS 4,612,867 9/1986 Rösch et al. ..... 112/314

4,766,828 8/1988 Nomura et al. ..... 112/314

4,777,896 10/1988 Nomura ..... 112/314

FOREIGN PATENT DOCUMENTS 3346163 4/1985 Fed. Rep. of Germany .

*Primary Examiner*—Peter Nerbun

*Attorney, Agent, or Firm*—Oliff & Berridge

[57] ABSTRACT

A pattern-matching sewing machine that constantly samples photo-intensity data during calculation of a mismatch distance and during adjustment of the feeding mechanism based on the calculated mismatch distance. When the adjustment is finished, a new mismatch-distance calculation is quickly started, not by waiting for sampling new photo-intensity data of a predetermined number, but by using photo-intensity data of the predetermined number including the data thus sampled during the previous calculation and adjustment, and the previously stored data which have been used in the previous calculation.

4 Claims, 14 Drawing Sheets

PATTERN-MATCHING SEWING MACHINE

BACKGROUND OF THE INVENTION

This invention relates to a pattern-matching sewing machine, for sewing two sheets, such as cloths, each bearing the same patterns with the patterns matching.

Published Unexamined Japanese Patent Application No. S60-153896 (which corresponds to the U.S. Pat. No. 4,612,867, and the German Patent Application DE 33 46 163 C1) discloses a pattern-matching sewing machine of this type. In this machine, a photo-sensor is placed before the sewing point to generate intensity data representing the brightness of the patterns on the two cloths. The mismatch distance of the patterns on the two cloths is detected using the intensity data, and the relative feed amount of the two cloths is adjusted according to the mismatch distance to maintain the pattern match.

However, the sewing machine, after collecting a predetermined number of photo-intensity data and adjusting the mismatch distance by relatively moving one cloth to the other (at q in FIG. 16), waits till the predetermined number of photo-intensity data are collected (r) again. Then, the next mismatch distance is calculated (s) and adjusted (t). A step motor for adjusting the mismatch distance is driven only at the adjustment of the mismatch distance (q and t), so its dormant period is long (530 msec). Especially, when the pattern recurring is long, i.e., when the predetermined number is large, the step motor adjusts the mismatch distance fewer times, resulting in slow response and inaccuracy in the pattern-matching control. Further, when the step motor adjusts a long mismatch distance at a time, either of the two cloths may wrinkle. That is, one adjustment of the mismatch distance should be small.

SUMMARY OF THE INVENTION

An object of this invention is therefore to provide a pattern-matching sewing machine which can match the patterns smoothly and accurately.

The machine according to the present invention for joining two sheets having a same pattern to match the patterns on respective sheets comprises, as shown in FIG. 1: the first and second feeding means M1 each for intermittently feeding one of the sheets; the first and second photo-sensing means M2 each for optically sensing the pattern on one of the sheets during feeding and for generating photo-intensity data of a plurality of points on the sheet; the memory M3 for sequentially storing a plurality of the photo-intensity data; the data retrieval means M4 for retrieving a predetermined number of the newest photo-intensity data from the memory every preset cycle time, the predetermined number corresponding to a preset feeding distance of the sheets, and the preset cycle time being shorter than a feeding time for the preset feeding distance; the mismatch detecting means M5 for calculating a mismatch distance of the patterns on the two sheets using the predetermined number of retrieved data, the calculation being finished within the preset cycle time; and the feed-adjusting means M6, based on the calculated mismatch distance, for adjusting one of the feeding means to match the patterns. The two sheets are sewn by the sewing means M7.

DETAILED DESCRIPTION OF PREFERRED EMBODIMENTS

Figure 1:
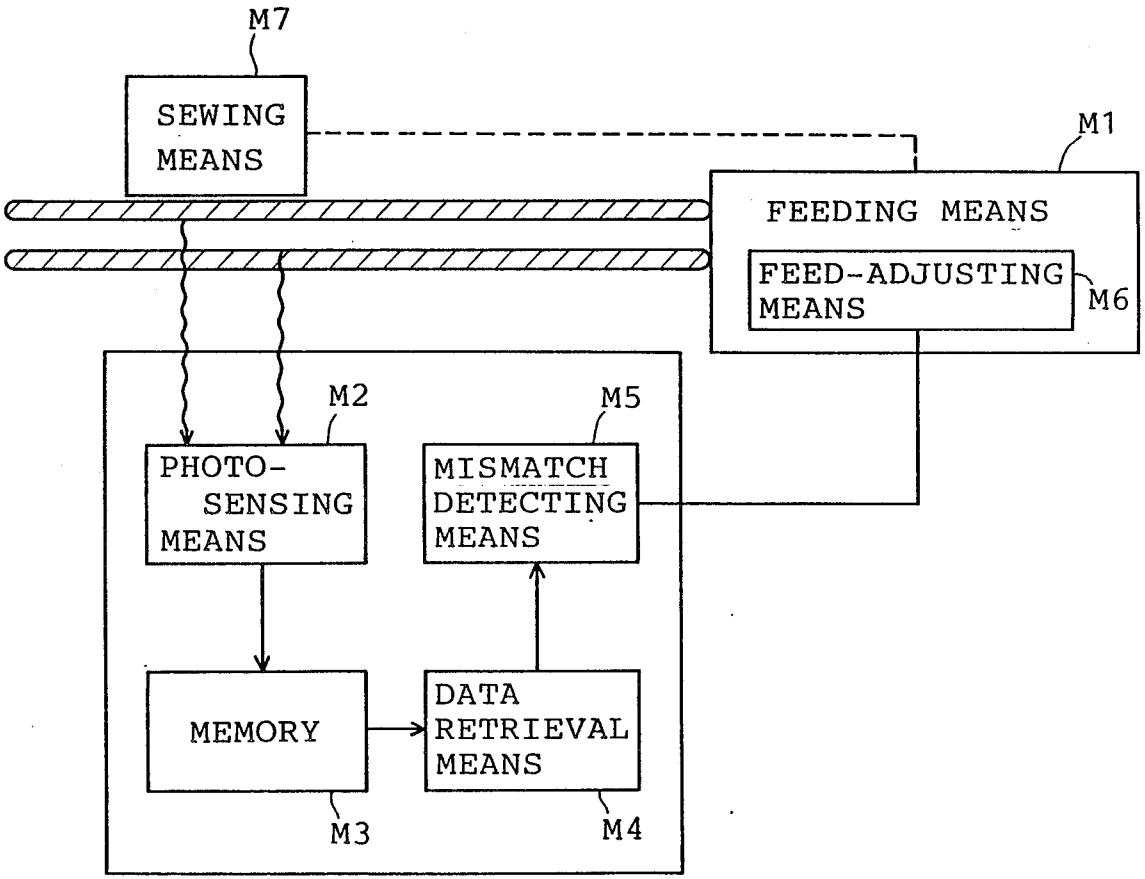
FIG. 1 is a block diagram, illustrating a typical structure of a pattern-matching sewing machine using this invention.
Figure 2:
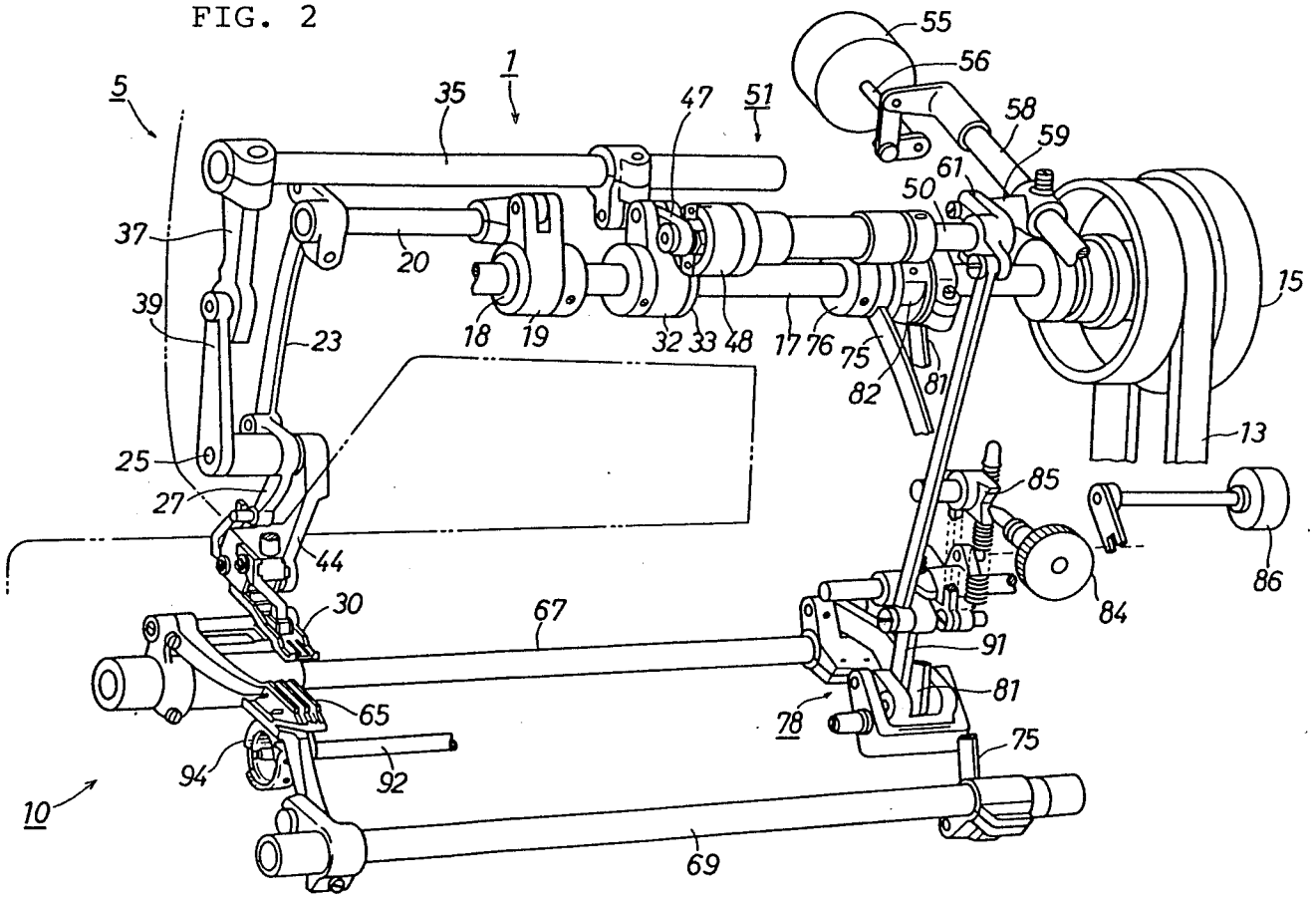
FIG. 2 schematically illustrates the mechanical structure of a sewing machine embodying the invention.

FIG. 2 illustrates a sewing machine 1 as an embodiment of the present invention. This sewing machine 1 is controlled by a microcomputer to sew two cloths having the same pattern so their patterns match. The mechanical structure of the sewing machine 1 is explained first.

As in FIG. 2, the sewing machine 1 includes an arm part 5 and a bed part 10. The arm part 5 includes a main shaft 17 that is driven by a main motor 190 (FIG. 4) via a belt 13 and a pulley 15. The main shaft 17 has an eccentric ca 18 that connects to a working shaft 20 via a crank rod 19. Thus the working shaft 20 rotates through a predetermined angle with the rotation of the main shaft 17 and gives a connection link 23 a vertical motion. The connection link 23 connects to an arm 27 that swings about a support shaft 25. The swinging motion of the arm 27 gives an upper feed dog 30 vertical motion.

The main shaft 17 connects, via a crank rod 32, another eccentric cam 33, and a link 47, to a working shaft 35. The working shaft 35 swings through a predetermined angle in according to the rotation of the shaft 17 to impart a stroke motion to levers 37 and 39. The lever 39 is articulated with an arm 44 which swings about the shaft 25. The swinging motion of the arm 44 imparts a stroke drive to the upper feed dog 30. Thus the upper feed dog 30 makes a four-motion feed: up, forward, down, and backward.

The stroke motion amount of the upper feed dog 30, i.e., the feed amount of the upper cloth, is determined by the swinging motion amount of the shaft 35. The link 47 connects to an upper feed adjuster 48 fit on one end of a rotary shaft 50. The adjuster 48 changes the swinging motion amount of the shaft 35 by changing the inclination of the link 47. The crank rod 32, eccentric cam 33, link 47, upper feed adjuster 48 and rotary shaft 50 form an upper feed adjusting mechanism 51.

At the other end of the shaft 50 is a rotary lever 61 with two oppositely extending arms. One arm abuts on a stopper 59 attached to a drive shaft 58 that is connected to an output shaft 56 of a step motor 55. Accordingly the step motor 55 moves the stopper 59, the stopper 59 regulates the lever 61, and the lever 61 limits the rotating angle of the shaft 50 and the swing of the shaft 35, which determines the upper feed amount.

The bed part 10 includes a horizontal feed shaft 67 and a vertical feed shaft 69 for making a lower feed dog 65 into four-motion feed like the upper feed dog 30. The vertical feed shaft 69 is connected, via a crank rod 75 and an eccentric cam 76, to the main shaft 17, and rotates through a predetermined angle with the rotation of the shaft 17 to give the lower feed dog 65 a vertical motion. The horizontal feed shaft 67 is connected, via a lower feed adjuster 78, a crank rod 81, and the eccentric cam 82, to the main shaft 17, and rotates through a predetermined angle with the rotation of the main shaft 17 to give the lower feed dog 65 a horizontal motion. The lower feed adjuster 78 converts the longitudinal motion of the crank rod 81, which is driven by the rotation of the main shaft 17, to the swinging motion of the horizontal feed shaft 67, and regulates the swing distance.

A manual feed control knob 84 is provided outside of the frame of the sewing machine 1 to adjust the inclination of a feed set notch 85 against which the end of the knob 84 abuts. The notch 85 is connected to the adjuster 78 via a link 91. When its inclination is changed, the feed amount is changed by the lower feed adjuster 78. The lower feed amount thus can be changed by the manual feed control knob 84. The notch 85 also connects to a potentiometer 86 that generates a signal corresponding to the lower feed amount.

Figure 3:
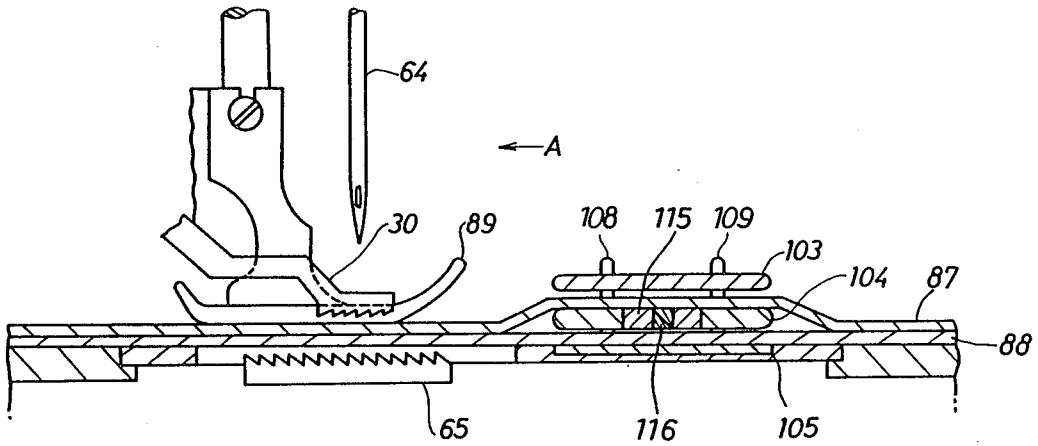
FIG. 3 illustrates the stitching section of the sewing machine.

A needle 64 (FIG. 3) is attached to a needle bar (not shown) which moves vertically synchronously with the main shaft 17. Within the bed part 10 below the needle 64 is a loop taker 94 attached to a lower shaft 92 which also rotates synchronously with the main shaft 17. Accordingly, at the sewing part (FIG. 3), synchronously with the rotation of the main shaft 17, the needle 64 and the loop taker 94 cooperate to sew together two cloths 87, 88 set under a presser foot 89, and the upper and the lower feed dogs 30 and 65 feed them in direction A (FIGS. 3 and 4) with the four-motion feed.

Upstream of the sewing part, three guide plates 103, 104, and 105 are placed in parallel to the machine bed, in which the lower guide plate 105 is embedded. Two pins 108 and 109 (FIGS. 3 and 4) stand upward on the lower guide plate 105 to penetrate long holes formed in the middle and upper plates 104 and 103, and guide the side edges of the cloths 87 and 88.

Figure 5A:
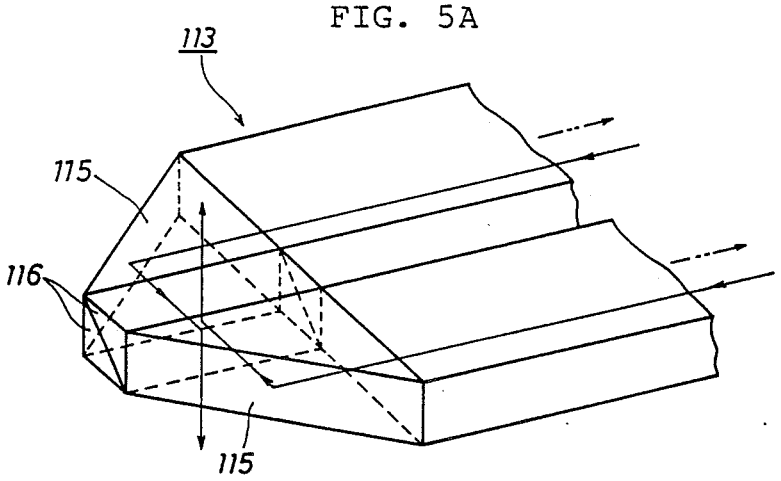
FIGS. 5A and 5B illustrate end of the pattern detector and an internal structure of its light conduit.
Figure 5B:
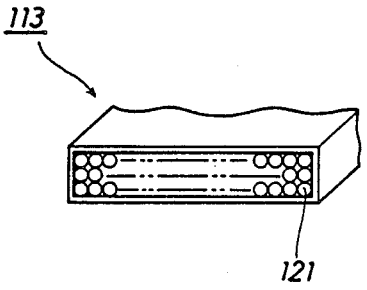

A detector 113 for detecting patterns on the two cloths 87 and 88 is embedded in the middle guide plate 104. As shown in FIG. 5A, prisms 115 and 116 are attached at the tip of the detector 113. Light from a conduit is reflected by the prisms 115 and 116 to the cloths 87 and 88, and the light reflected by the surfaces of the cloths 87 and 88 retraces the incident path. As shown in FIG. 5B, the conduit in the detector 113 includes a bundle of optical fibers 121 that connects to a control box 124 of the sewing machine 1.

The optical fibers 121 include fibers 127 (FIG. 4) for projecting the light and fibers 129 and 131 for receiving the light. The projecting fibers 127 communicate with a light source unit 133, and the receiving fibers 129 and 131 with photo-sensors 144 and 148, in the control box 124. In the light source unit 133, a lamp 141 projects white light into the fibers 127 through a lens 138. The fibers 129 and the photo-sensor 144 correspond to the upper cloth 87, and the fibers 131 and the photo-sensor 148 correspond to the lower cloth 88.

Figure 6:
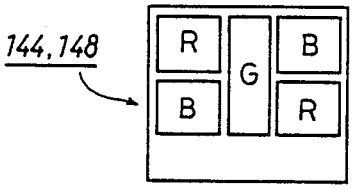
FIG. 6 illustrates an arrangement for color filters in a photo-sensor.

As shown in FIG. 6, the photo-sensors 144 and 148 have red (R), green (G) and blue (B) of color filters, and a photo diode corresponding to each color filter. Plural color filters of the same color are arranged apart so as to obtain a broader scope for receiving stray light. That is, even if the light from the fibers 129 and 131 to the sensors 144 and 148 is skewed, it can be detected by any one of the matching color filters.

The light reflected by the cloths 87 and 88 is decomposed into the three primary colors (R, G and B) by the color filters, and the intensity data for respective colors are generated in the photo-sensors 144 and 148. The color intensity data are sent to an electronic control unit 160 built within the control box 124.

Figure 4:
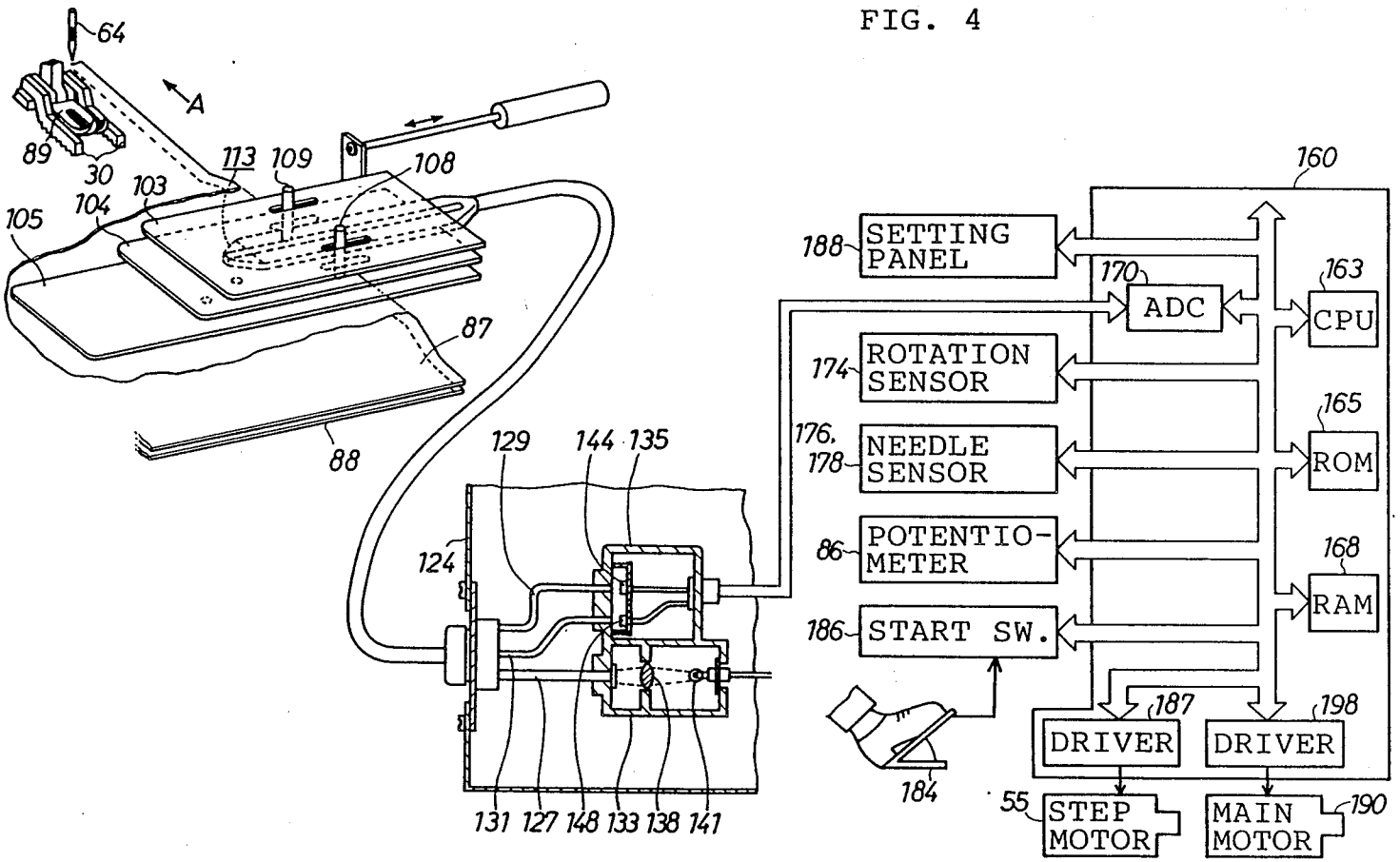
FIG. 4 illustrates the structure of a pattern detector and its control unit.

As shown in FIG. 4, the electronic control unit 160 is a microcomputer including a CPU (central processing unit) 163, ROM (read only memory) 165, RAM (random access memory) 168, an analog-to-digital converter (ADC) 170, and driver circuits 187 and 198. The ADC 170 connects to the photo-sensors 144 and 148, the driver circuit 187 to the upper-feed adjusting step motor 55, and the drive circuit 198 to the main motor 190 of the sewing machine 1. The electronic control unit 160 also connects to: a rotation sensor 174 on the pulley 15 for generating twenty-four (24) pulse signals per rotation of the main shaft 17; needle position sensors 176 and 178 also in the pulley 15 for generating low-position and high-position signals, respectively, for the needle position; the potentiometer 86 for detecting the lower feed amount; a start switch 186 at a pedal 184 for generating start and stop signals for sewing; and a setting panel 188 for setting the pattern-setting parameters according to patterns on the cloths 87 and 88.

Figure 7:
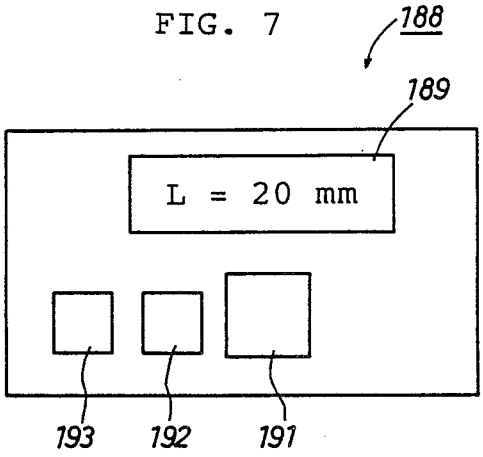
FIG. 7 illustrates a setting panel.

As shown in FIG. 7, the setting panel 188 includes a liquid crystal display 189, a changing key 191 for initiating a change of the preset length for the control of mismatch distance calculation, and an increment key 192 and a decrement key 193 for increasing and decreasing the length when the changing key 191 is operated. A control routine for pattern matching is stored in the ROM 165. In the RAM 168, data areas corresponding to a reference number Cm are allocated to sequentially store color data sets sensed by the photo-sensors 144 and 148. The pattern-matching control routine of the sewing machine 1 is now described.

Figure 8A:
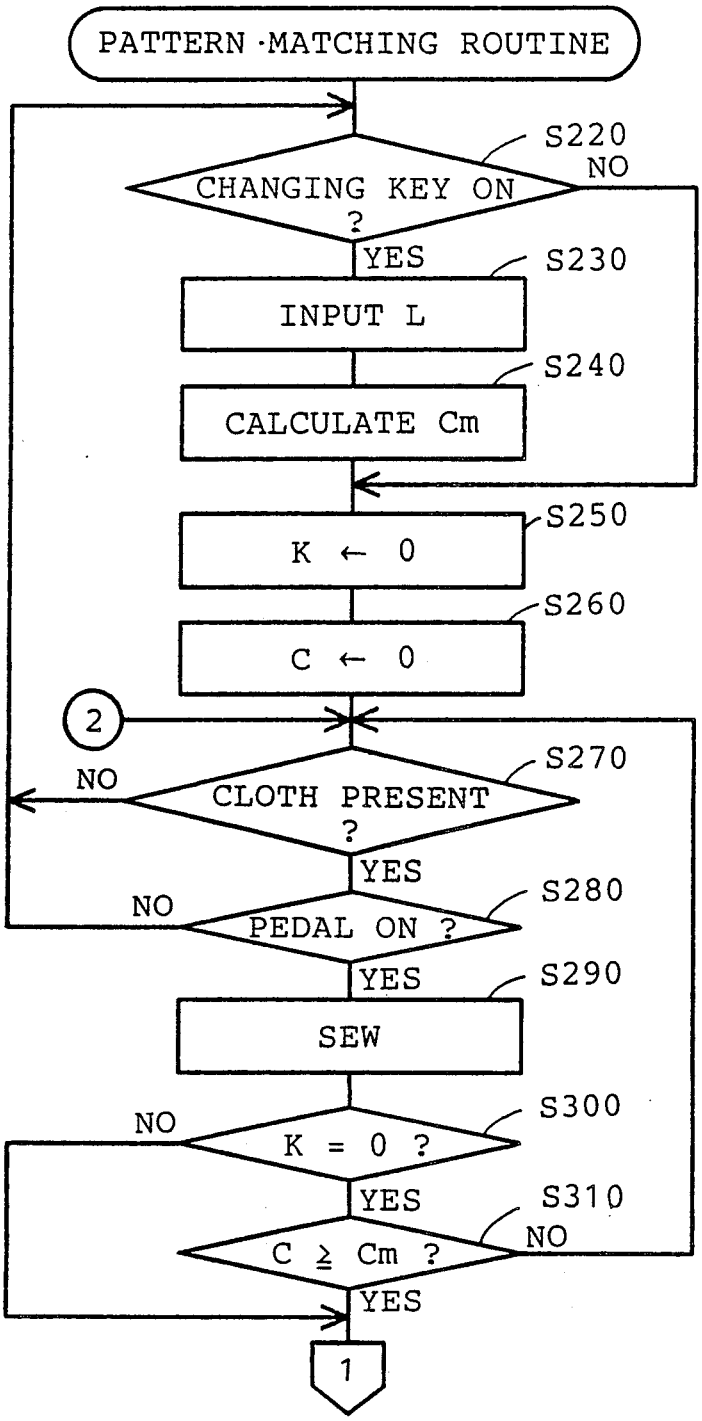
FIGS. 8A and 8B are flowcharts of a pattern-matching control routine.
Figure 8B:
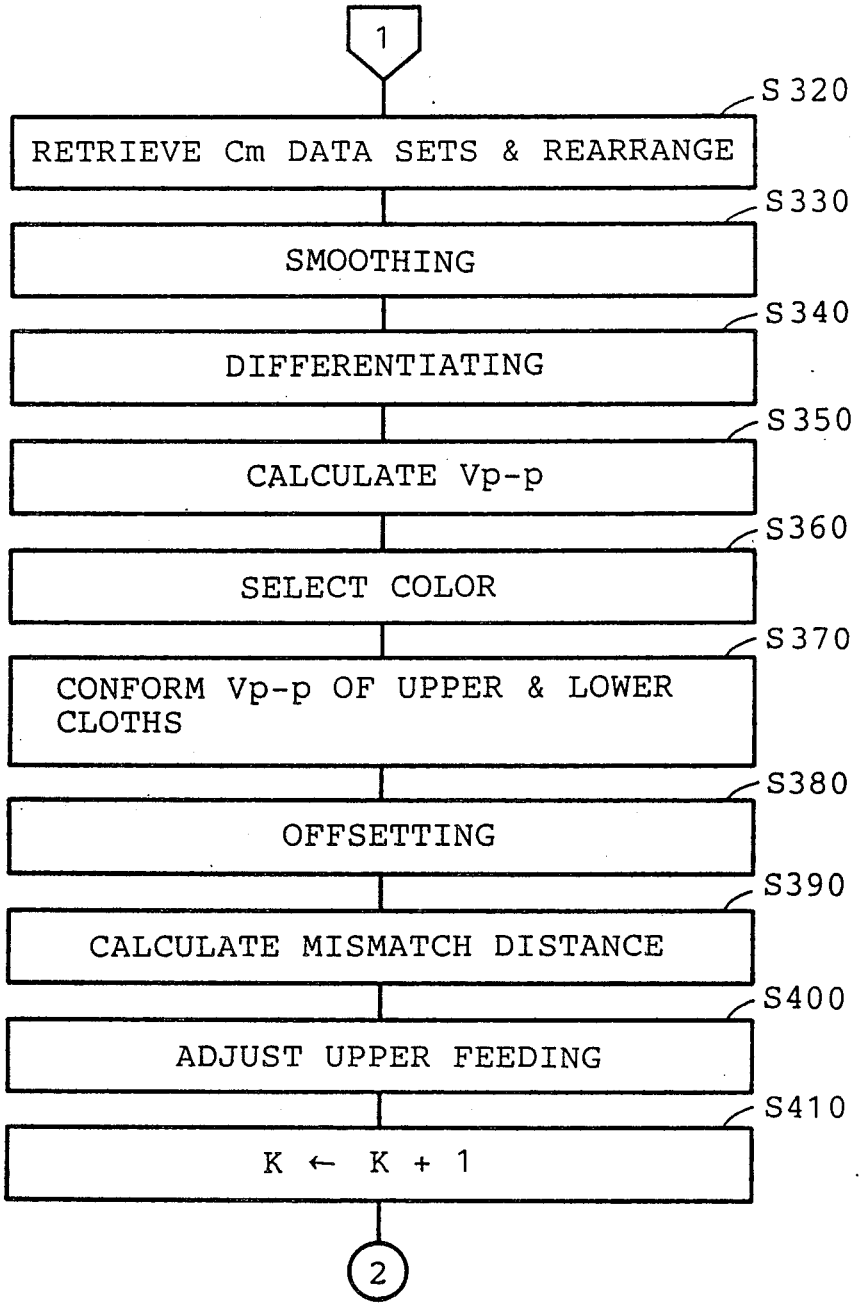
Figure 9:
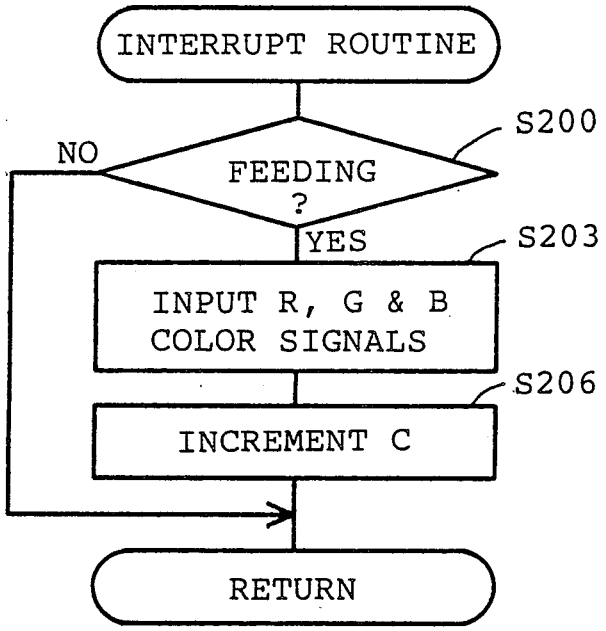
FIG. 9 is a flowchart of an interrupt processing routine.

FIGS. 8A and 8B are flow charts for a pattern-matching control routine, and FIG. 9 is a flowchart of an interrupt processing routine. A value of the preset length that was previously set on the setting panel 188 before the power was turned off is preserved by a backed-up memory, and, when the power of the sewing machine 1 is turned on, the stored value becomes an initial value. When the sewing machine 1 is used for the first time, or if it has not been used for a long time, the preset length L is set at 20 mm, and the reference number Cm is determined based on the length L and the lower feed amount output from the potentiometer 86. When cloths different from those handled before are to be sewn, the operator turns on the changing key 191, and pushes the increment or decrement key 192 or 193 to set a new length L corresponding to the new pattern. Normally the length L is set slightly longer than the longest repeating segment of the pattern, and L should be longer than the longest solid (or unpatterned) segment of the pattern to detect any intensity change.

Figure 10:
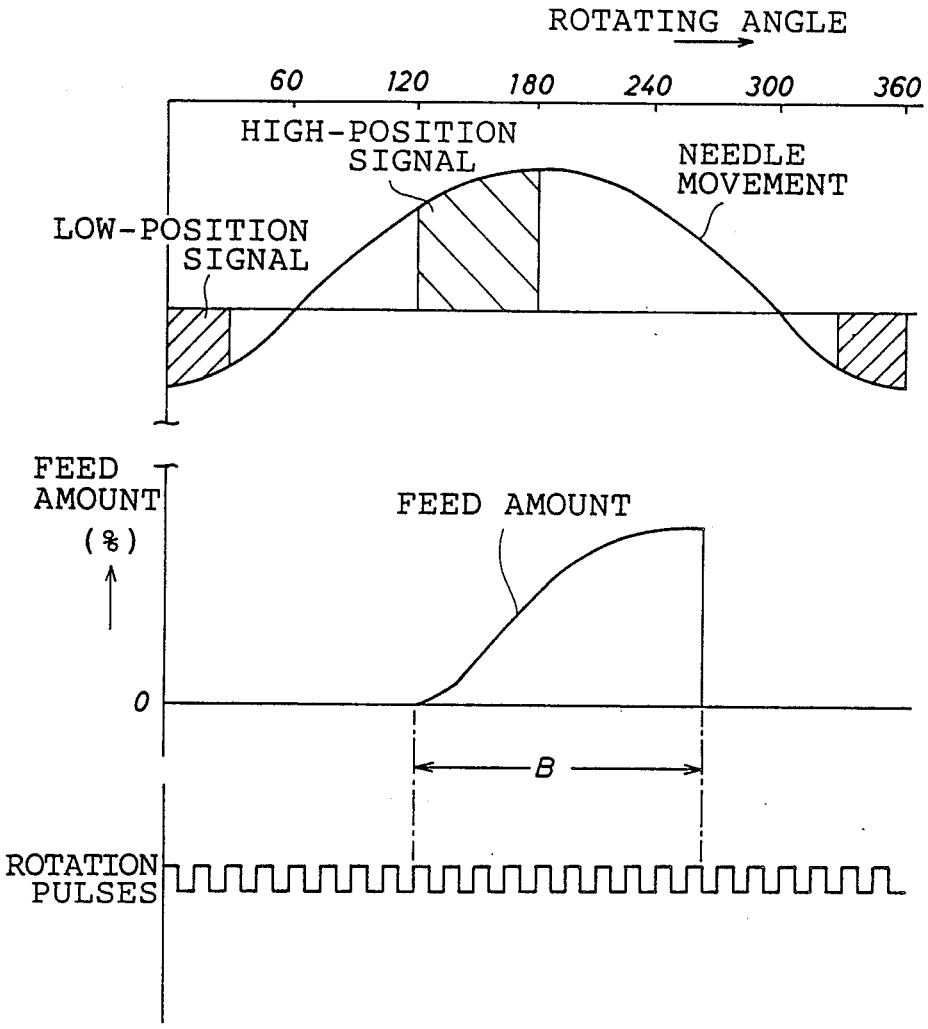
FIG. 10 is a graph illustrating needle position, feed amount and pulse signals generated by a rotation sensor.

First, the interrupt processing routine (FIG. 9) is explained. This routine is started at every falling edge of the rotation pulse signal from the rotation sensor 174. As shown in FIG. 10, the rotation sensor 174 generates twenty-four (24) pulse signals during a rotation of the main shaft 17, so that each time the main shaft 17 rotates through fifteen (15) degrees, the routine is executed.

In the interrupt processing routine, it is first examined at step S200, whether the pulse signal from the rotation sensor 174 is within a cloth feeding movement (B in FIG. 10). If not, the routine ends. If the pulse signal from the rotation sensor 174 is within the feeding movement, six color intensity data (red, green and blue intensity data from the upper cloth 87 and the lower cloth 88) sensed by the photo-sensors 144 and 148 are converted to digital signals by the ADC 170 and are stored as one set of color data in the RAM 168 (step S203). A counter C for the color data set is incremented by one at step S206, and this routine ends. Thus the color data sets are stored in the preset areas of the RAM 168.

The pattern-matching control routine is now explained with FIGS. 8A and 8B. This routine is executed at a preset time interval. First the state of the changing key 191 is examined at step S220. When the key 191 is not turned on, the length L is not changed and the process goes to step S250. When the key 191 is turned on, the length L set by the operator is input at step S230, and the reference number Cm is calculated at step S240. The number Cm represents the number of color data sets corresponding to the length L, and is calculated as follows:

$$Cm = Np.L/Df,$$

where Np is the number of pulses in the feeding range and Df is the feed amount. For example, when the length L is set at 30 mm and the feed amount is 1 mm, Cm is calculated as 10 (pulses)×30 (mm)/1 (mm)=300, since the number of pulse signals is 10 (pulses) per main shaft rotation in the feeding stage.

Subsequently, a control counter K and the counter C for the color data sets stored in the RAM 168 are cleared at zero at steps S250 and S260. Then, the CPU 163 waits until the upper and lower cloths 87 and 88 are set and the pedal 184 is pressed at steps S270 and S280, respectively, at which time the CPU 163 drives the main motor 190 to start sewing at step S290.

While the main motor 190 rotates during sewing, the interrupt processing routine (FIG. 9) is repeatedly executed and the color data sets are sequentially stored in the preset data areas of the RAM 168. When the control counter K is 0 and the number of color data sets C is less than the reference number Cm at steps S300 and S310, respectively, the process returns to step S270, while the sewing continues.

Figure 11:
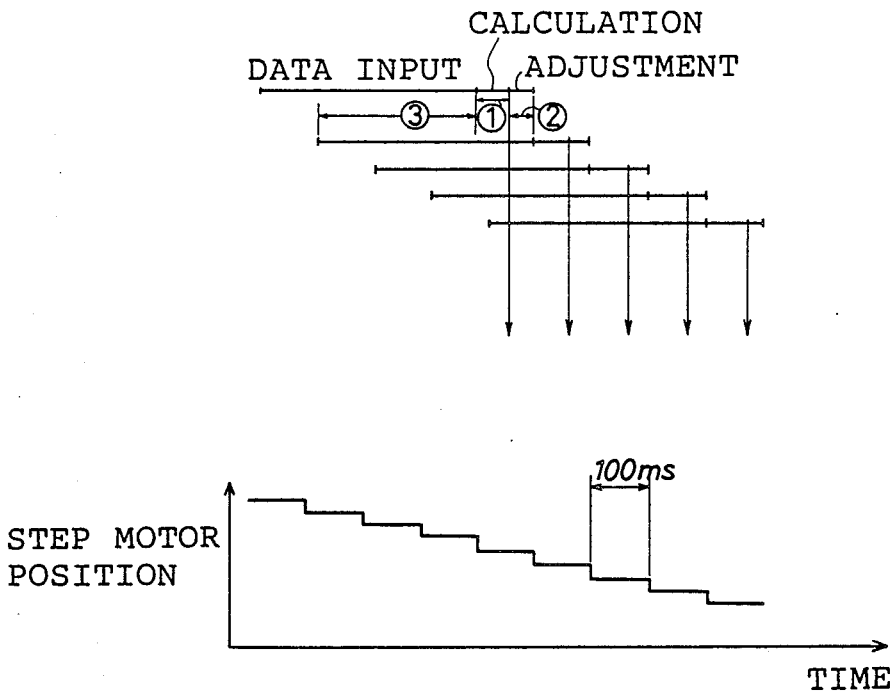
FIG. 11 illustrates the pattern-matching processing in the sewing machine of the embodiment.

When the number C reaches Cm, i.e., the first reference number Cm of the color data sets are stored, the pattern matching processing in FIG. 8B is executed. Once Cm data sets are stored in the RAM 168, it is unnecessary for the next time to wait till the number C reaches Cm at step 310. As shown in FIG. 11, from the second time and after, Cm data sets are collected with: the data sets stored during the previous routine (③); the new data sets stored during previous calculation of the mismatch distance (①); and the new data sets stored during previous adjustment of the upper feed amount (②). Thus, the calculation cycle of the mismatch distance is shorter (100 msec), resulting in frequent adjustment of the upper feed amount.

Figure 12B:
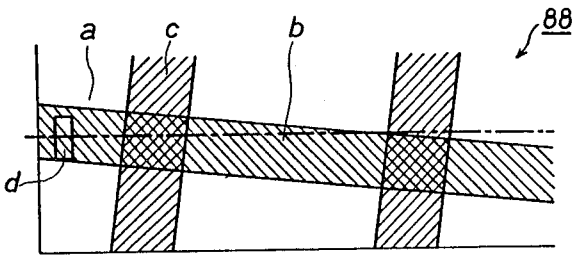
FIGS. 12A and 12B illustrate example patterns of the embodiment.
Figure 12D:
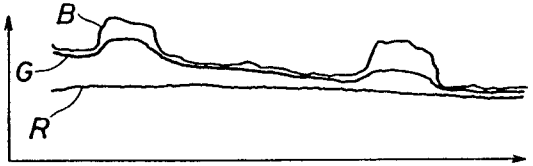
FIGS. 12C and 12D respectively illustrate color data for an upper cloth in FIG. 12A and those for a lower cloth in FIG. 12B.
Figure 12A:
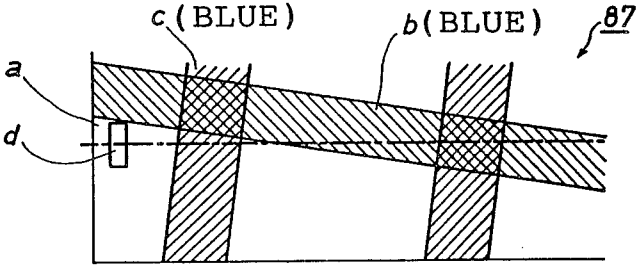

Now the case where the upper and lower cloths 87 and 88 having the same pattern are mismatched, as shown in FIGS. 12A and 12B, is explained. The pattern is composed of a gray background a (gray cloth) with a check of longitudinal (with respect to the feeding direction) b and transverse c blue lines. Both blue colors of the check pattern have equal brightness to the gray cloth color, so, special treatment is necessary to distinguish the blue check pattern from the background color in the pattern matching. Further, the pattern matching is better for the transverse lines c than for the longitudinal lines b.

Figure 12C:
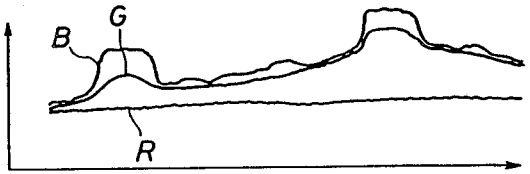

Reference letter d in FIG. 12A designates the area of photo-detection. After Cm sets of color data are collected by the photo-sensor system at step S310 (FIG. 8A), the latest collected Cm color data sets are retrieved from the RAM 168 at step S320 and the subsequent data processing is done on those data sets. The retrieved data are rearranged into six data sequences, each respectively corresponding to red (R), green (G), and blue (B) intensity data sequences for the upper cloth 87, and red (R), green (G), and blue (B) for the lower cloth 88. The data sequences are shown in FIGS. 12C and 12D.

Figure 13A:
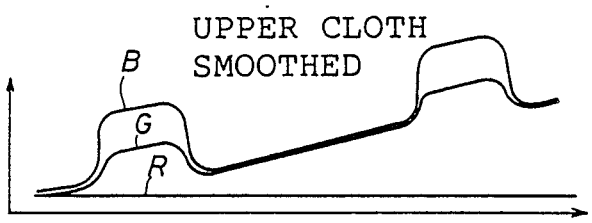
FIGS. 13A and 13B are graphs showing the smoothed data.
Figure 13B:
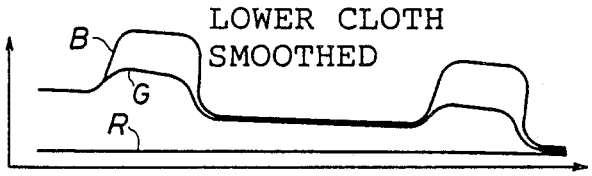

Then a smoothing (averaging) operation is performed for every point of each data sequence at step S330. That is, intensity data of 21 points from before and after a point is added to the intensity data of that point, and the sum is divided by 43 (=21+1+21) to obtain the smoothed data for that point. FIGS. 13A and 13B show the smoothed data.

Figure 14A:
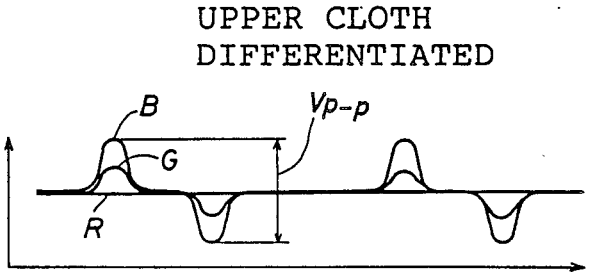
FIGS. 14A and 14B are graphs showing the differentiated data.
Figure 14B:
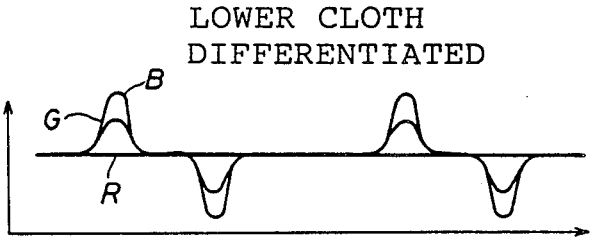

The smoothed data is then differentiated at step S340. The results are shown in FIGS. 14A and 14B which show that the differentiating operation emphasizes the acute changes and diminishes gentle changes in the smoothed data. Therefore, a gentle change caused by the longitudinal line b is removed from the differentiated data.

In the subsequent step S350, a peak height Vp-p between the maximum and minimum peak values of the differentiated data for each color of the upper and lower cloths 87 and 88 is calculated.

The peak heights Vp-p of the upper and the lower cloths 87 and 88 are added for each of the three colors R, G and B, and the color with the greatest sum is selected at step S360. In FIGS. 14A and 14B, the blue (B) color has the greatest sum, i.e., has the greatest intensity change, so the blue color is selected.

The differentiated data (of the selected blue color) of either the upper and lower cloths is amplified as necessary so that their peak heights Vp-p become equal at step S370.

Then, an offset processing is performed at step S380: an average value of all points is subtracted from each point so that the average value of the blue differentiated data becomes 0.

Figure 15:
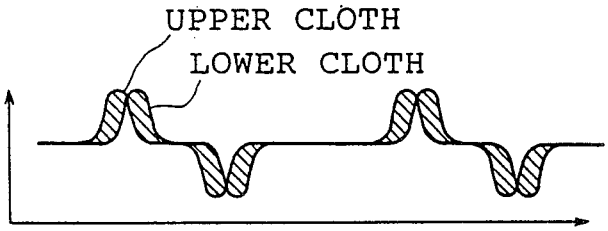
FIG. 15 illustrates the superposition of differentiated data peaks for the upper and lower cloths.
Figure 16:
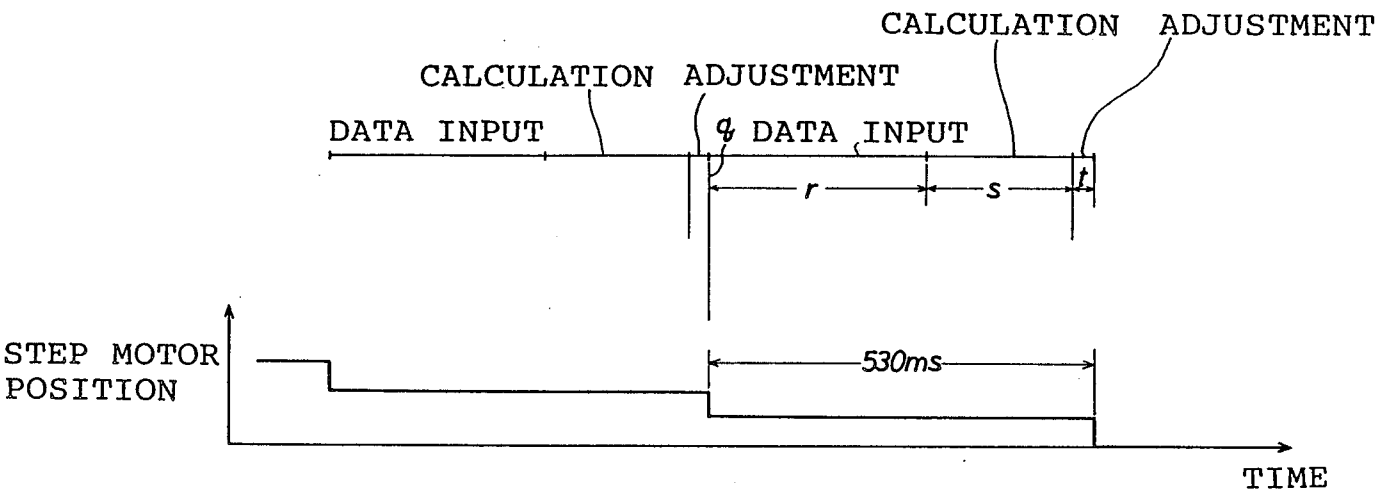
FIG. 16 PRIOR ART
FIG. 16 illustrates a pattern-matching processing in the prior-art sewing machine.

Then the mismatch distance is calculated based on the offset-processed data at step S390. Specifically, the offset-processed differentiated data of the upper and lower cloths 87 and 88 are superposed as shown in FIG. 15, and the difference area of the two curves (shaded in FIG. 15) is measured. The differentiated data are shifted in the data feed direction, and when the difference area becomes minimum, that shifted distance is the mismatch distance.

The step motor 55 is driven according to the calculated mismatch distance to adjust the upper-feed amount at step S400. When the adjustment of the upper-feed amount is completed, the control counter K is incremented by one at step S410 and the present routine ends. When the counter K is not equal to 0, the result at step S300 in the next pattern-matching routine is "NO" so that the mismatch distance is calculated without waiting for the storage of another new Cm color data sets.

As explained above, during calculation of a mismatch distance and during adjustment of the upper feed amount by the step motor 55, the sewing machine of this embodiment constantly samples new color data, and, after the adjustment, a new calculation is quickly started with Cm color data sets including thus sampled color data and the previously stored color data which have been used in the previous calculation.

According to the sewing machine 1 of this embodiment, the calculation cycle of the mismatch distance and the driving cycle of the step motor 55 are shorter so that the response and accuracy in the pattern-matching control improve. As a result, even a long-range pattern is adjusted little by little with a quick response, thereby preventing the cloth from wrinkling. Further, the most suitable color is selected for each Cm data sets corresponds to the preset length L so that, without changing color filters, any color change or a pattern change in sewing can be successfully handled.

This invention is not limited to the details of above embodiment and various changes and modifications are possible without departing from the spirit and scope of the invention.

What is claimed is:

1. A sewing machine for sewing two sheets having the same pattern comprising:

first and second feeding means each for intermittently feeding one of the sheets;

first and second photo-sensing means each for optically sensing the pattern on one of the sheets during feeding and for generating photo-intensity data of a plurality of points on the sheet;

a memory for sequentially storing a plurality of the photo-intensity data;

a data retrieval means for retrieving a predetermined number of the newest photo-intensity data from the memory every preset cycle time, the predetermined number corresponding to a preset feeding distance of the sheets, and the preset cycle time being shorter than a feeding time for the preset feeding distance;

a mismatch detecting means for calculating a mismatch distance of the patterns on the two sheets using the predetermined number of retrieved data, the calculation being finished within the preset cycle time; and a feed-adjusting means, based on the calculated mismatch distance, for adjusting one of the feeding means to match the patterns.

2. The sewing machine, as in claim 1, which further comprises a distance-setting switch by which an operator sets the preset feeding distance regarding the longest solid segment of the pattern on the sheets.

3. The sewing machine, as in claim 1, where each of the first and second photo-sensing means separately generates photo-intensity data of red, blue and green colors.

4. The sewing machine, as in claim 3, where the mismatch detecting means comprises:

first through sixth averaging means each for averaging one of the three color intensity data generated by one of the photo-sensing means, the averaging for each point being performed by first adding value of data of several points before and after the point to the value of data of the point, and then dividing the sum by the number of the points;

first through sixth differentiating means each for calculating a differential of the respective averaged color intensity data;

first through sixth peak height detecting means each for detecting a peak-to-peak height of the respective differentiated color intensity data; and a selecting means for selecting one of the color intensity data that has the largest peak-to-peak height, the color intensity data being used for calculating the mis-match distance.

* * * * *

UNITED STATES PATENT AND TRADEMARK OFFICE

CERTIFICATE OF CORRECTION

PATENT NO. : 4,898,110

DATED : February 6, 1990

INVENTOR(S) : Etsuzo NOMURA ET AL

It is certified that error appears in the above-identified patent and that said Letters Patent is hereby corrected as shown below:

On the title page

Item [73] Assignee, should read "BROTHER KOGYO KABUSHIKI KAISHA, Aichi, Japan."

Signed and Sealed this

Fourth Day of December, 1990

*Attest:*

HARRY F. MANBECK, JR.

*Attesting Officer*

*Commissioner of Patents and Trademarks*